US008656531B1

(12) United States Patent
Holmes et al.

(10) Patent No.: US 8,656,531 B1
(45) Date of Patent: Feb. 25, 2014

(54) APPARATUSES AND METHODS TO FACILITATE COT ASSEMBLY

(71) Applicant: High Country Concepts, LLC, Cedar Hill, UT (US)

(72) Inventors: Scott Holmes, Cedar Hills, UT (US); Shawn Parry, Salt Lake City, UT (US); Eric Lin, Fremont, CA (US)

(73) Assignee: High Country Concepts, LLC, Cedar Hills, UT (US)

( * ) Notice: Subject to any disclaimer, the term of this patent is extended or adjusted under 35 U.S.C. 154(b) by 0 days.

(21) Appl. No.: 13/827,963

(22) Filed: Mar. 14, 2013

(51) Int. Cl.
*A47C 17/64* (2006.01)

(52) U.S. Cl.
USPC ..... 5/110; 5/111; 5/112; 5/114

(58) Field of Classification Search
USPC ..... 5/110–117, 625–629, 620, 200.1, 201, 5/282.1, 285, 286, 288, 305
See application file for complete search history.

(56) References Cited

U.S. PATENT DOCUMENTS

| | | | | | |
|---|---|---|---|---|---|
| 174,624 | A * | 3/1876 | Fyler | 5/114 |
| 198,869 | A * | 1/1878 | Bradley | 5/117 |
| 1,170,229 | A * | 2/1916 | Ferguson | 5/117 |
| 1,176,657 | A * | 3/1916 | Darling | 5/112 |
| 1,335,548 | A * | 3/1920 | Basford | 5/112 |
| 1,360,201 | A * | 11/1920 | Dyett | 5/117 |
| 1,510,592 | A * | 10/1924 | Fleming et al. | 5/190 |
| 1,568,409 | A * | 1/1926 | Miller | 5/114 |
| 1,624,965 | A * | 4/1927 | Moore | 5/114 |
| 1,694,420 | A * | 12/1928 | Joselowitz | 5/112 |
| 1,787,566 | A * | 1/1931 | Brown | 5/117 |
| 1,813,019 | A * | 7/1931 | Brown | 5/114 |
| 2,611,906 | A * | 9/1952 | Backer | 5/117 |
| 2,611,908 | A * | 9/1952 | Siggers | 5/187 |
| 5,555,576 | A * | 9/1996 | Kim | 5/114 |
| 6,553,586 | B1 | 4/2003 | Lin | |
| 6,618,879 | B1 * | 9/2003 | Wu | 5/111 |
| 7,856,683 | B2 | 12/2010 | Zheng | |
| 8,296,879 | B2 * | 10/2012 | Lin | 5/111 |
| 8,419,134 | B1 | 4/2013 | Yuan | |
| 2009/0178195 | A1 | 7/2009 | Zheng | |
| 2012/0117727 | A1 * | 5/2012 | Lin | 5/111 |

* cited by examiner

*Primary Examiner* — Robert G Santos
(74) *Attorney, Agent, or Firm* — Austin Rapp & Hardman

(57) ABSTRACT

The disclosed cot may include a first side rail having a first connection mechanism, a second side rail having a second connection mechanism, a leg secured to the second side rail, a pivoting mechanism that pivotally secures the leg to the second side rail. An end rail may include a third connection mechanism that engages with the first connection mechanism and a fourth connection mechanism that engages with second connection mechanism. The cot may further comprise a pivoting arm having a proximal end that pivotally engages with the leg, the first side rail, the second side rail, the end rail or a pivoting mechanism that enables the leg to pivot relative to one of the side rails. The pivoting arm may comprise a distal end having a sixth connection mechanism that engages with a fifth connection mechanism disposed on another portion of the cot.

20 Claims, 10 Drawing Sheets

APPARATUSES AND METHODS TO FACILITATE COT ASSEMBLY

TECHNICAL FIELD

The present invention relates generally to cots. More specifically, the present invention relates apparatuses and methods to facilitate cot assembly.

BACKGROUND

Assembling conventional cots can be difficult, particularly in poor lighting conditions or on uneven terrain as frequently occurs during camping experiences. In addition or alternatively, it may be desirable that a support fabric of a cot be stretched or pulled tight to achieve a desired level of tautness during assembly of the cot. However, achieving a desired tautness level may make assembly of the cot difficult and may require more strength than certain users of the cot may possess. Accordingly, apparatuses and methods to facilitate cot assembly are desirable.

BRIEF DESCRIPTION OF THE DRAWINGS

Exemplary embodiments of the invention will become more fully apparent from the following description and appended claims, taken in conjunction with the accompanying drawings. Understanding that these drawings depict only exemplary embodiments and are, therefore, not to be considered limiting of the invention's scope, the exemplary embodiments of the invention will be described with additional specificity and detail through use of the accompanying drawings in which:

Figure 1:
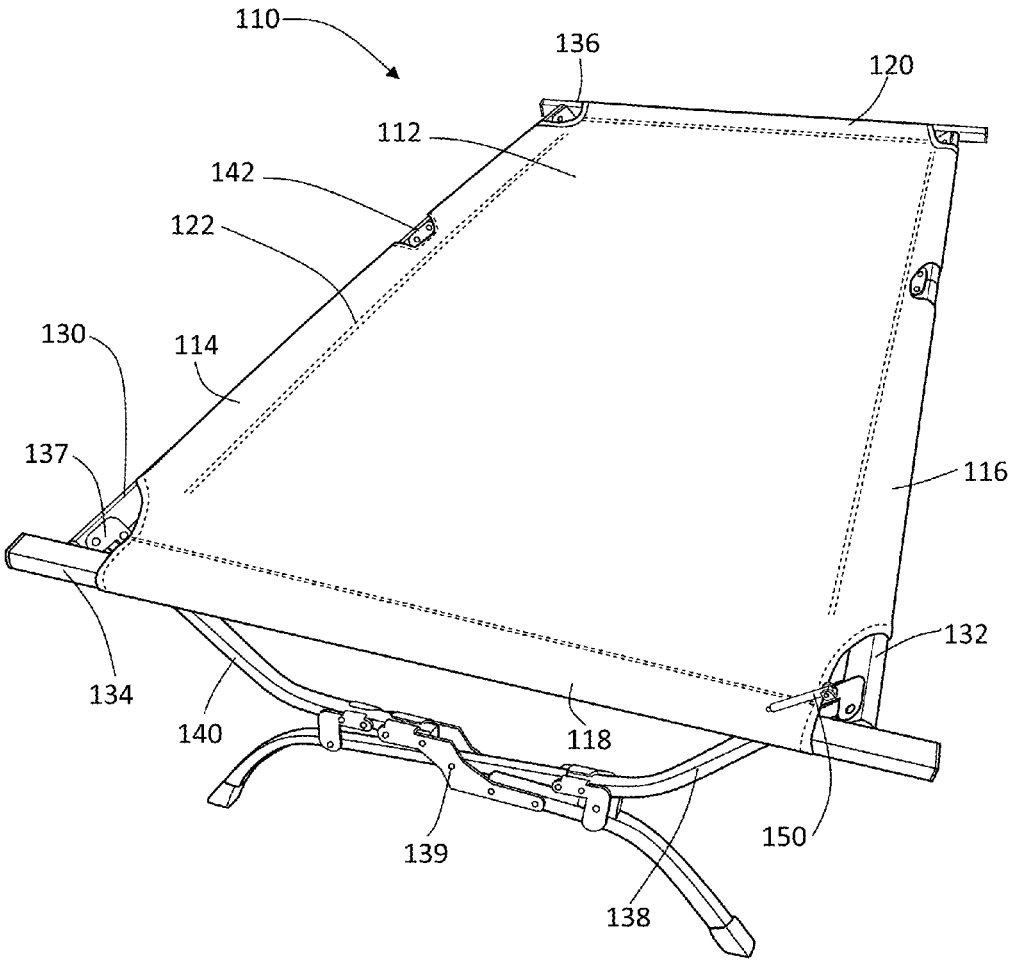
FIG. 1 is a perspective view of one embodiment of a cot including an assist arm.

In accordance with common practice, the various features illustrated in the drawings may not be drawn to scale. Accordingly, the dimensions of the various features may be arbitrarily expanded or reduced for clarity. In addition, some of the drawings may be simplified for clarity. Thus, the drawings may not depict all of the components of a given apparatus (e.g., device) or method. Finally, like reference numerals may be used to denote like features throughout the specification and figures.

SUMMARY

Embodiments of the disclosed subject matter are provided below for illustrative purposes and are in no way limiting of the claimed subject matter.

A folding cot having an assist arm is disclosed. The folding cot may include a first side rail having a first connection mechanism, a second side rail having a second connection mechanism, a leg secured to the second side rail, and a pivoting mechanism that pivotally secures the leg to the second side rail.

The cot may also include a support fabric having a first peripheral side channel shaped to receive the first side rail and a second peripheral side channel shaped to receive the second side rail with the first peripheral side channel and the second peripheral side channel being disposed on opposing sides of the support fabric;

The cot may comprise an end rail having a longitudinal axis, a third connection mechanism, a fourth connection mechanism, and a fifth connection mechanism. The third connection mechanism may be shaped to engage the first connection mechanism and may be located at a first fixed point along the longitudinal axis. The fourth connection mechanism may be shaped to engage with the second connection mechanism and may be located at a second fixed point along the longitudinal axis. The fifth connection mechanism may be located at a third fixed point between the first fixed point and the second fixed point relative to the longitudinal axis of the end rail.

The cot may further comprise an arm having a proximal end and a distal end with the proximal end pivotally secured to at least the leg or the pivoting mechanism and the distal end comprising a sixth connection mechanism shaped to interface with the fifth connection mechanism. The arm may be dimensioned such that when the sixth connection mechanism is engaged with the fifth connection mechanism and the first connection mechanism is engaged with the third connection mechanism, a pivotal radius of the fourth connection mechanism of the end rail intersects with an engaging position in which the fourth connection mechanism engages the second connection mechanism. In one embodiment, the proximal end of the arm is pivotally and rotatably secured to the leg.

The sixth connection mechanism may comprise a central extension and a recessed shoulder, and the fifth connection mechanism may comprise an aperture shaped to receive the central extension. The aperture may be surrounded by a reinforcing plate.

The first connection mechanism may comprise a head, a neck and a shoulder, while the third connection mechanism may comprise an opening having a wide region shaped to receive the head and a narrow region shaped to receive the neck.

An alternative embodiment of a cot having an assist arm is disclosed. The first side rail may have a first connection mechanism, a second side rail having a second connection mechanism, a leg secured to the second side rail, a support fabric having a first peripheral side channel shaped to receive the first side rail and a second peripheral side channel shaped to receive the second side rail with the first peripheral side channel and the second peripheral side channel being disposed on opposing sides of the support fabric.

The end rail may have a longitudinal axis, a third connection mechanism, a fourth connection mechanism, and a fifth connection mechanism. The third connection mechanism may be shaped to engage the first connection mechanism and may be located at a first fixed point along the longitudinal axis. The fourth connection mechanism may be shaped to engage with the second connection mechanism and may be located at a second fixed point along the longitudinal axis. The fifth connection mechanism may be located at a third fixed point located outside the first fixed point and the second fixed point along the longitudinal axis of the end rail.

The cot may comprise an arm having a proximal end, and a distal end with the proximal end being pivotally secured to the second side rail and the distal end comprising a sixth connection mechanism shaped to interface with the fifth connection mechanism. The arm may be dimensioned such that when the sixth connection mechanism is engaged with the fifth connection mechanism and the first connection mechanism is engaged with the third connection mechanism, a pivotal radius of the fourth connection mechanism of the end rail intersects with an engaging position in which the fourth connection mechanism engages the second connection mechanism.

The proximal end of the arm may be pivotally and rotatably secured to the leg.

The sixth connection mechanism may comprise a central extension and a recessed shoulder, while the fifth connection mechanism may comprise an aperture shaped to receive the central extension. The aperture may be surrounded by a reinforcing plate.

The first connection mechanism may comprise a head, a neck and a shoulder.

Yet another alternative embodiment of the cot having an assist arm may include a first side rail having a first connection mechanism, a second side rail having a second connection mechanism, and a leg secured to the second side rail.

The cot may comprise an end rail having a longitudinal axis, a third connection mechanism, and a fourth connection mechanism. The third connection mechanism may be shaped to engage the first connection mechanism and may be located at a first fixed point along the longitudinal axis. The fourth connection mechanism may be shaped to engage with the second connection mechanism and may be located at a second fixed point along the longitudinal axis. A fifth connection mechanism disposed on either the leg or the second side rail.

The cot may include a support fabric having a first peripheral side channel shaped to receive the first side rail and a second peripheral side channel shaped to receive the second side rail, a first end channel shaped to receive the end rail, the first peripheral side channel with the second peripheral side channel being disposed on opposing sides of the support fabric, and the first end channel being generally perpendicular to the first peripheral side channel.

The cot may also include an arm having a proximal end, and a distal end with the proximal end being pivotally secured to the end rail and the distal end comprising a sixth connection mechanism shaped to interface with the fifth connection mechanism. The arm may be dimensioned such that when the sixth connection mechanism is engaged with the fifth connection mechanism and the first connection mechanism is engaged with the third connection mechanism and the end rail is disposed within the first end channel, a pivotal radius of the fourth connection mechanism of the end rail intersects with an engaging position in which the fourth connection mechanism engages the second connection mechanism.

The fifth connection mechanism may be disposed on the side rail. Alternatively or additionally, the fifth connection mechanism may be disposed on the leg.

The cot may further comprising a third fixed point located on the end rail with the third fixed point being located between the first fixed point and the second fixed point relative to the longitudinal axis of the end rail, and the arm being pivotally secured to the third fixed point.

The cot may further comprise a third fixed point located on the end rail with the third fixed point being located outside the first fixed point and the second fixed point relative to the longitudinal axis of the end rail and the arm being pivotally secured to the third fixed point. The proximal end of the arm may be pivotally and rotatably secured to the end rail. Also, the sixth connection mechanism may comprise a central extension and a recessed shoulder.

DETAILED DESCRIPTION

Various aspects of the disclosure are described below. It should be apparent that the teachings herein may be embodied in a wide variety of forms and that any specific structure, function, or both being disclosed herein is merely representative. Based on the teachings herein, one skilled in the art should appreciate that an aspect disclosed herein may be implemented independently of any other aspects and that two or more of these aspects may be combined in various ways. For example, an apparatus may be implemented or a method may be practiced using any number of the aspects set forth herein. In addition, such an apparatus may be implemented or such a method may be practiced using other structure, functionality, or structure and functionality in addition to or other than one or more of the aspects set forth herein. Furthermore, an aspect may comprise at least one element of a claim.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

FIG. 1 is a perspective view of one embodiment of a cot 110 that includes an assist arm 150. The cot 110 may include a support fabric 112, a set of rails 130, 132, 134, 136, and a set of legs 138, 140. The support fabric 112 may include a series of channels, such as a first peripheral channel 114, a second peripheral channel 116, a first end channel 118, and a second end channel 120. The channels 114, 116, 118, 120, in various embodiments, may be formed by folding over the support fabric 112 and attaching an edge of the support fabric 112 to the body of the support fabric 112 using, for example, stitching 122 (as shown in FIG. 1), staples, rivets, or other types of attachment mechanisms. Alternatively, the support fabric 112 and channels 114, 116, 118, 120 may be formed, for example, by a molding process employing a polymer. The support fabric 112 and channels 114, 116, 118, 120, may be formed in various other ways beyond those discussed above.

As illustrated in FIG. 1, a first side rail 130 may be disposed within the first peripheral channel 114, a second side rail 132 may be disposed within a second peripheral channel 116, the first end rail 134 may be disposed within the first end channel 118, and the second end rail 136 may be disposed within the second end channel 120 when the cot 110 is in an assembled condition. The rails, 130, 132, 134, 136 may comprise a hollow metal or carbon fiber bar. The rails 130, 132, 134, 136 may also be formed of various other materials and may, for example, be hollow or solid. In addition the rails 130, 132, 134 136 may optionally include one or more hinge mechanisms 142 to facilitate folding, storage, and transportation of the cot 110.

The cot 110 may include legs 138, 140 to elevate the support fabric 112 above an underlying surface. In the illustrated embodiment, the cot 110 may include six legs, although only a first leg 138 and a second leg 140 are visible in the perspective view shown in FIG. 1. The legs 138, 140 may also include one or more pivoting joints 139 to facilitate folding, storage, and transportation of the cot 110. In various embodiments, the legs 138, 140 may be fixedly or pivotally secured to one or more of the rails 130, 132, 134, 136 using various pivoting mechanisms 137.

The assist arm 150 may be pivotally secured to the second side rail 132, as illustrated in FIG. 1. The assist arm 150 facilitates assembly of the cot 110. Further details regarding the assist arm 150 will be provided in connection with subsequent figures.

Figure 2:
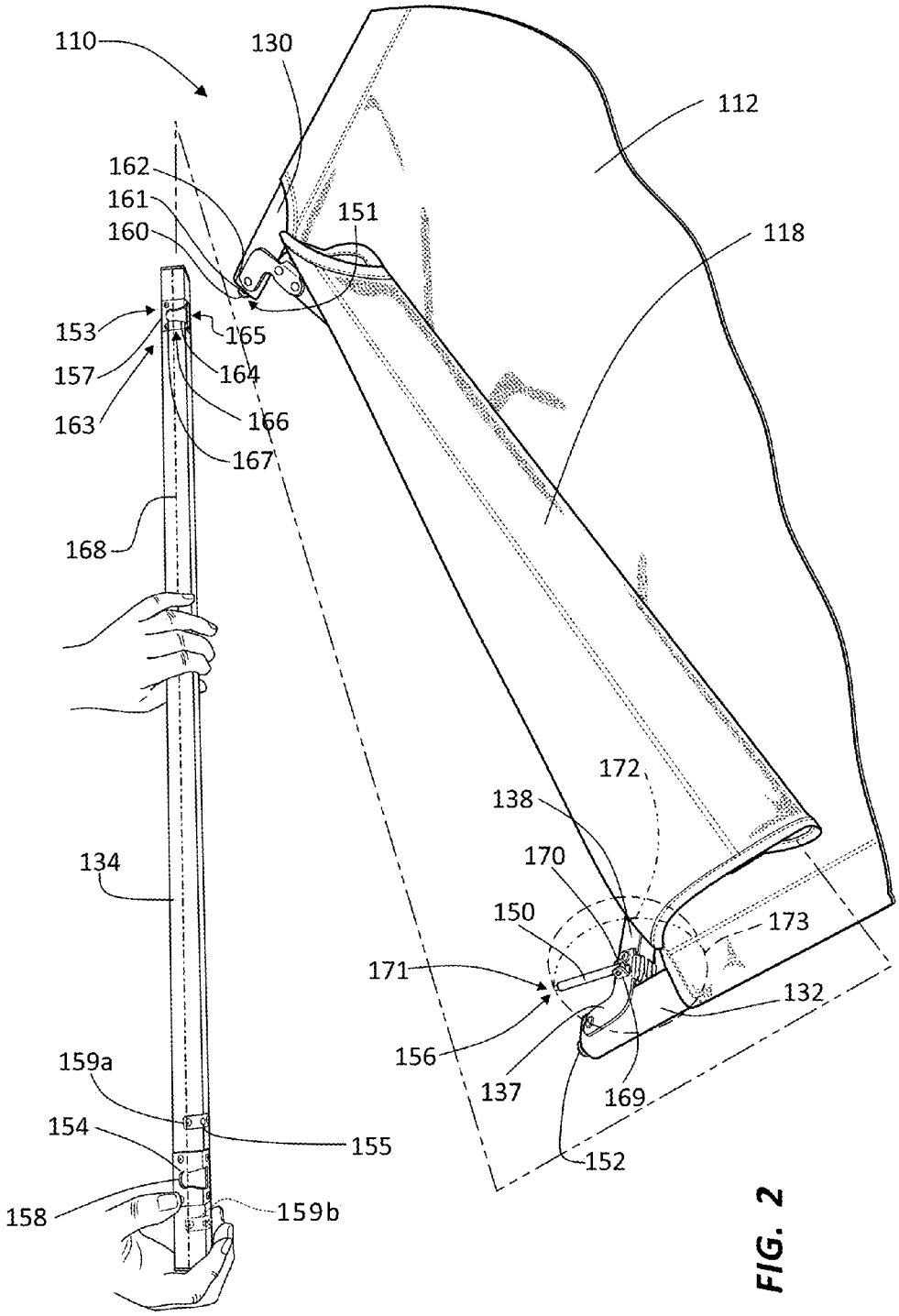
FIG. 2 is a partial perspective view of the embodiment of the cot of FIG. 1 with an end rail removed from an end channel of the support fabric.

FIG. 2 is a partial perspective view of the cot 110 shown in FIG. 1 with the first end rail 134 removed from the first end channel 118 of the support fabric 112. As illustrated in FIG. 2, the first side rail 130 has (i.e., comprises or is secured to) a first connection mechanism 151, the second side rail 132 has a second connection mechanism 152. In addition, the first end rail 134 has a third connection mechanism 153, a fourth connection mechanism 154, and a fifth connection mechanism 155. In addition, the arm 150 illustrated in FIG. 2 has a sixth connection mechanism 156. The third connection mechanism 153 may be positioned at a first fixed point 157 relative to a longitudinal axis 168 of the first end rail 134, and the fourth connection mechanism 154 may be positioned at a second fixed point 158 relative to the longitudinal axis 168. In the embodiment of the cot 110 illustrated in FIG. 2, the fifth connection mechanism 155 is positioned at an inside third fixed point 159*a*. The inside third fixed point 159*a* is positioned between the second fixed point 158 and the first fixed point 157 relative to the longitudinal axis 168 of the first end rail 134. In alternative embodiments, the fifth connection mechanism 155 may be positioned on an outside third fixed point 159*b*. The outside third fixed point 159*b* is positioned outside the first fixed point 157 and the second fixed point 158 relative to or along the longitudinal axis 168 of the first end rail 134.

The first connection mechanism 151 of the first side rail 130 may be shaped to engage with the third connection mechanism 153 of the first end rail 134, while the second connection mechanism 152 of the second side rail 132 may be shaped to engage with the fourth connection mechanism 154 of the first end rail 134. In addition, the fifth connection mechanism 155 of the first end rail 134 may be shaped to engage with the sixth connection mechanism 156 of the arm 150.

In various embodiments, the first connection mechanism 151 may include a head 160, a narrow neck 161 and a shoulder 162. The first connection mechanism 151 may be described as a male-type connection mechanism. The third connection mechanism 153 may comprise an opening 163 for receiving a first connection mechanism 151. The third connection mechanism 153 may be described as a female-type connection mechanism. In various embodiments, the opening 163 of the third connection mechanism 153 may comprise a wide region 165 for receiving the head 160 of the first connection mechanism 151 and a narrow region 164 for receiving the neck 161 of the first connection mechanism 151. The narrow region 164 may comprise a narrowing channel 166 contiguous with an expanded region 167. The neck 161 of the first connection mechanism 151 may pass through the narrowing channel 166 of the third connection mechanism 153 until it is positioned within the expanded region 167, such that the first connection mechanism 151 is engaged with the third connection mechanism 153. When the first connection mechanism 151 is engaged with the third connection mechanism 153 and the second connection mechanism 152 is not engaged with the fourth connection mechanism 154, the first end rail 134 may pivot relative to the first fixed point 157.

The assist arm 150 may include a proximal end 170 and a distal end 171. The proximal end 170 is the end of the arm 150 closest to the linking mechanism 169, while the distal end 171 is the end of the arm 150 most remote from the linking mechanism 169. The distal end 171 comprises a sixth connection mechanism 156 shaped to engage the fifth connection mechanism 155 of the first end rail 134.

The proximal end 170 of the arm 150 may be pivotally secured to the first leg 138 through the pivoting mechanism 137 (which pivotally secures the first leg 138 to the second side rail 132) using a linking mechanism 169. The linking mechanism 169 may comprise an attachment component for securing the arm 150 to the first leg 138. The attachment component may comprise one or more of various attachment mechanisms, such as a bolt and nut assembly, adhesives, rivets.

In various embodiments, the linking mechanism 169 only enables the arm 150 to pivot with respect to the first leg 138 within a generally planar region, such as the planar pivot region 172 shown in FIG. 2. In various alternative embodiments, the linking mechanism 169 enables the arm 150 to both pivot and rotate with respect to the leg 138 within a generally half spherical region, such as within the generally half spherical region 173 illustrated in FIG. 2. In various embodiments, the assist arm 150 is secured only to the pivoting mechanism 137 (which pivotally secures the first leg 138 to the second side rail 132) rather than being also secured to the first leg 138.

The cot 110 illustrated in FIGS. 1 and 2 includes only one assist arm 150. In alternative embodiments, the cot 110 may comprise more than one assist arm 150, such as an assist arm 150 pivotally secured to two or four legs of the cot 110.

The connection mechanisms 151-156 shown in FIG. 2 are only illustrative. Various different types of connection mechanisms 151-156 may be utilized within the scope of the disclosed subject matter. For example, the first connection mechanism 151 may be described as comprises a male-type connection mechanism 151, while the third connection mechanism 153 may be described as comprises a generally female-type connection mechanism 153. In alternative embodiments, for example, the third connection mechanism 153 may comprise a male-type connection mechanism, while the first connection mechanism 151 may comprise a female-type connection mechanism. Also, in alternative embodiments, second connection mechanism 152 may comprise a female-type connection mechanism, while the fourth connection mechanism 154 may comprise a male-type connection mechanism. Further, as illustrated in FIG. 2, the sixth connection mechanism 156 comprises a male-type connection mechanism, while the fifth connection mechanism 155 comprises a female-type connection mechanism. In alternative embodiments, the sixth connection mechanism 156 may comprise a female-type connection mechanism, while the fifth connection mechanism 155 may comprise a male-type connection mechanism.

Figure 3:
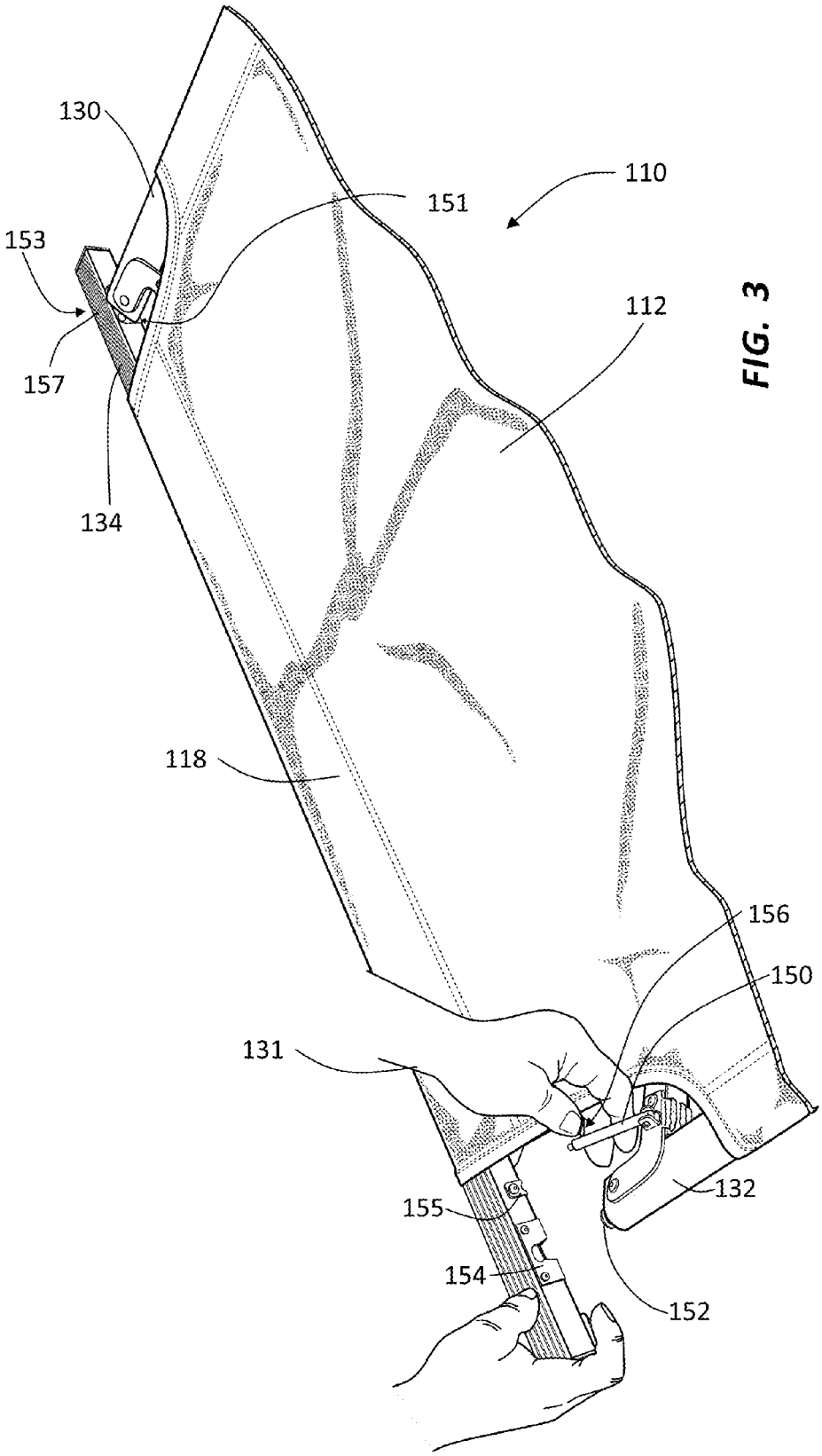
FIGS. 3-7 comprise partial perspective views illustrating a method of assembly of the embodiment of the cot of FIG. 1.

FIGS. 3-7 illustrate a method of using the assist arm 150 to assemble the cot 110. As illustrated in FIG. 3, the first end rail 134 may been inserted and positioned within the first end channel 118. Further, as illustrated in FIG. 3, the first connection mechanism 151 of the first side rail 130 may be engaged with the third connection mechanism 153 of the first end rail 134. Without the benefit of the assist arm 150, it can be difficult for a user 131 to secure the second connection mechanism 152 of the second side rail 132 to the fourth connection mechanism 154 of the first end channel 118.

Figure 4:
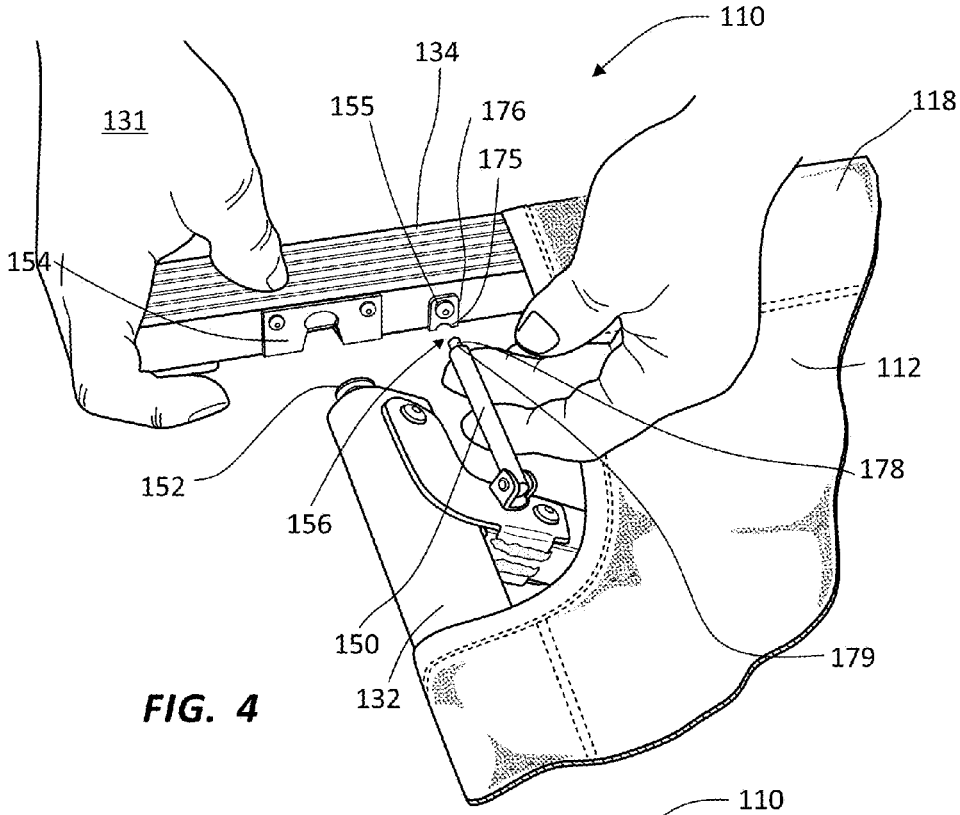

Accordingly, as illustrated in FIG. 4, a user 131 may secure the arm 150, while also holding the first end rail 134. As illustrated, the fifth connection mechanism 155 of the first end rail 134, in one embodiment, may comprise a reinforcing plate 176 and an aperture 175. In addition, the sixth connection mechanism 156 may comprise a central extension 178 with a recessed shoulder 179. The aperture 175 may be sized to receive the central extension 178. As indicated previously, the fifth and sixth connection mechanisms 155-156 may be embodied in different ways than those illustrated in FIGS. 1-7. For example, in alternative embodiments, the sixth connection mechanism 156 of the arm 150 may comprise an aperture or recess, while the fifth connection mechanism 155 may comprise an extension sized to be disposed or received within the aperture or recess. Also, in alternative embodiments, the extension 178 may not be centered with respect to the recessed shoulder 179 and thus may comprise an offset extension 178.

Figure 5:
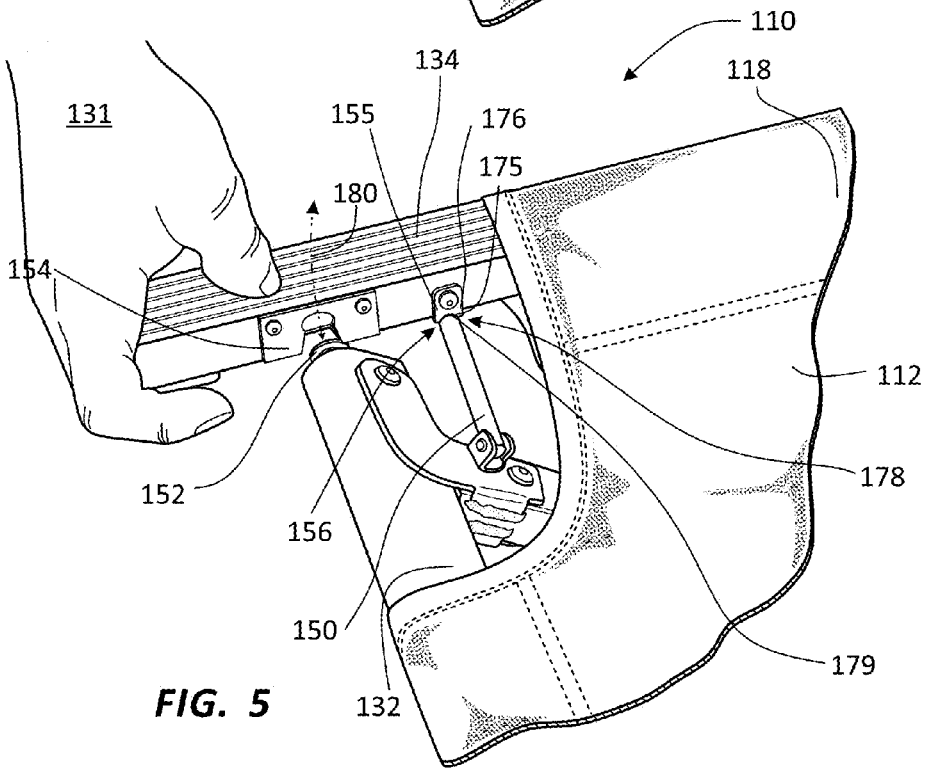
Figure 6:
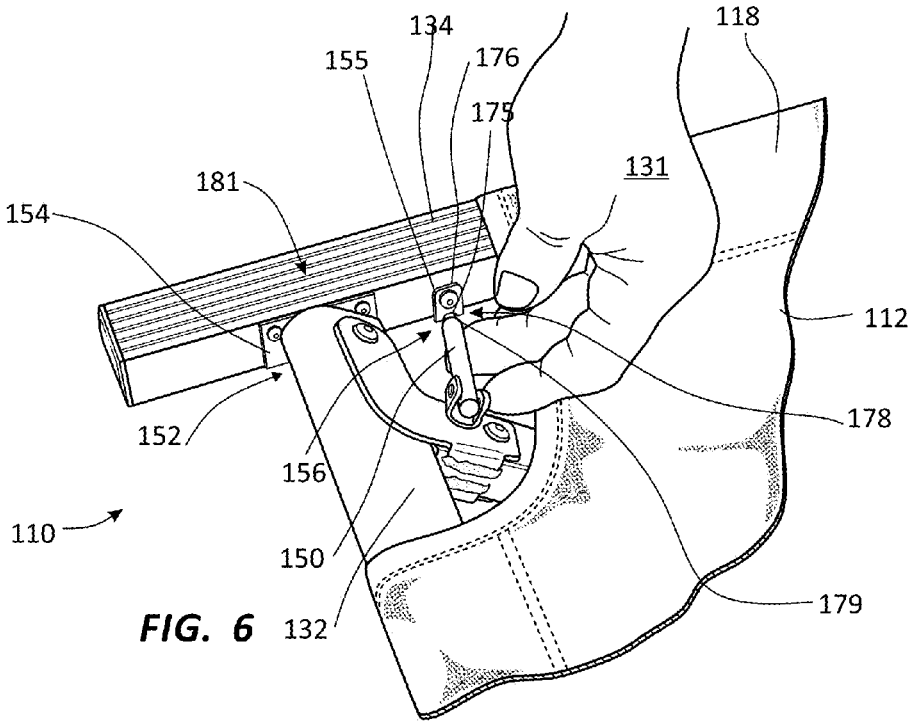

As shown in FIGS. 5-6, the first end rail 134 may be pivoted such that the fifth connection mechanism 155 engages the sixth connection mechanism 156 of the arm 150. In this state, the pivotal radius 180 of the fourth connection mechanism 154 may intersect with the engaging position 181, in which the fourth connection mechanism 154 of the first end rail 134 engages the second connection mechanism 152 of the second side rail 132, which is illustrated specifically in FIG. 6. The arm 150, the engagement between the fifth connection mechanism 155 and the sixth connection mechanism 156, and the engagement between the fifth connection mechanism 155 and the sixth connection mechanism 156, enable a user 131 to more easily and apply the necessary force guide the fourth connection mechanism 154 of the first end rail 134 and the second connection mechanism 152 of the second side rail 132 into the engaging position 181.

Figure 7:
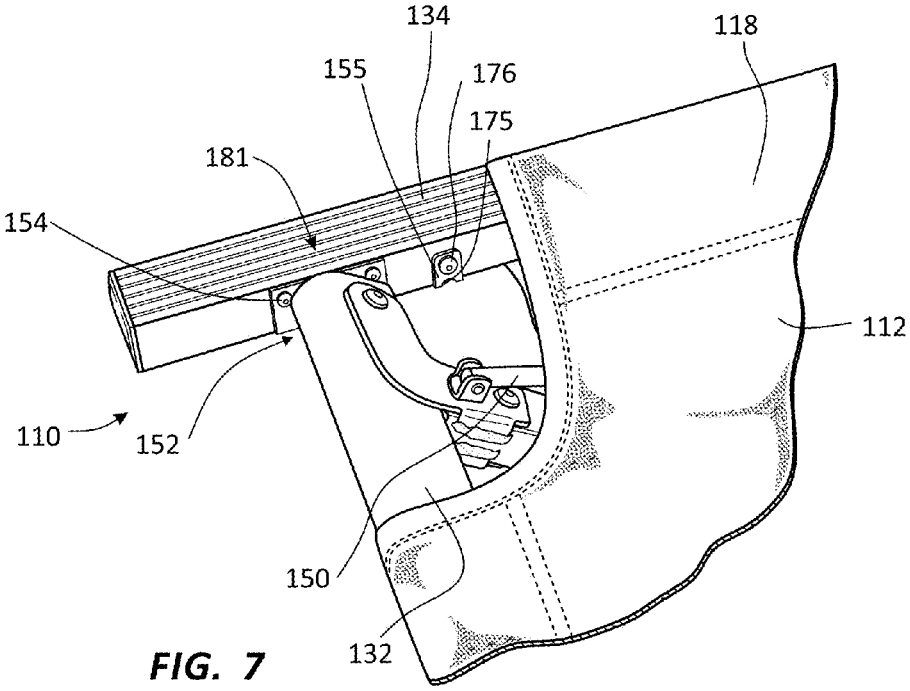

As illustrated in FIG. 7, once the second connection mechanism 152 has engaged the fourth connection mechanism 154, the fifth connection mechanism 155 and the sixth connection mechanism 156 may disengage.

Figure 8:
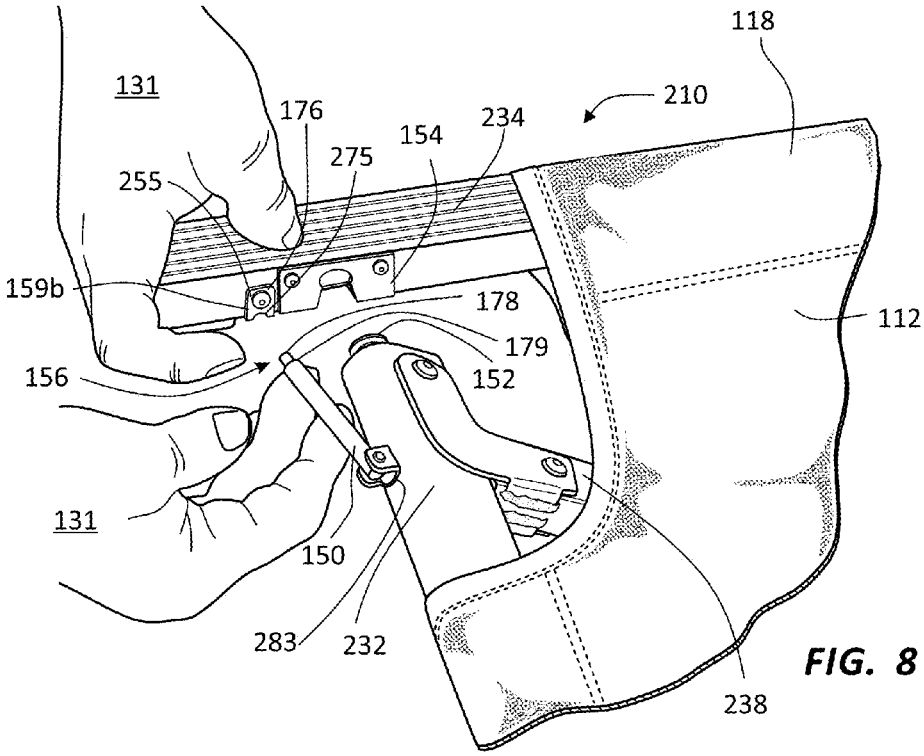
FIGS. 8-10 comprise partial perspective views illustrating a method of assembly of an alternative embodiment of a cot.
Figure 9:
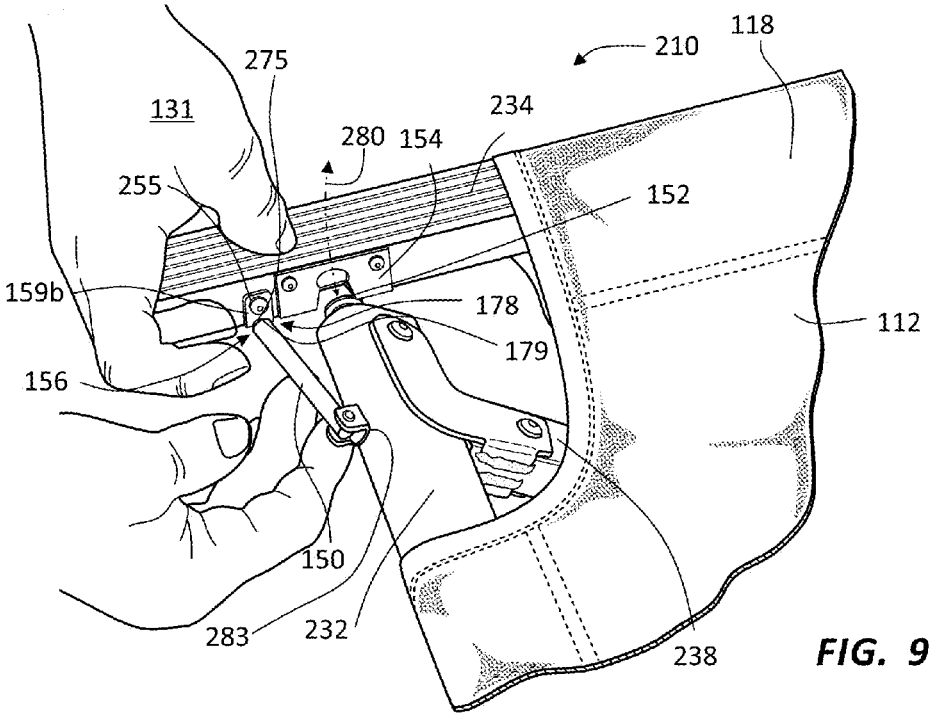
Figure 10:
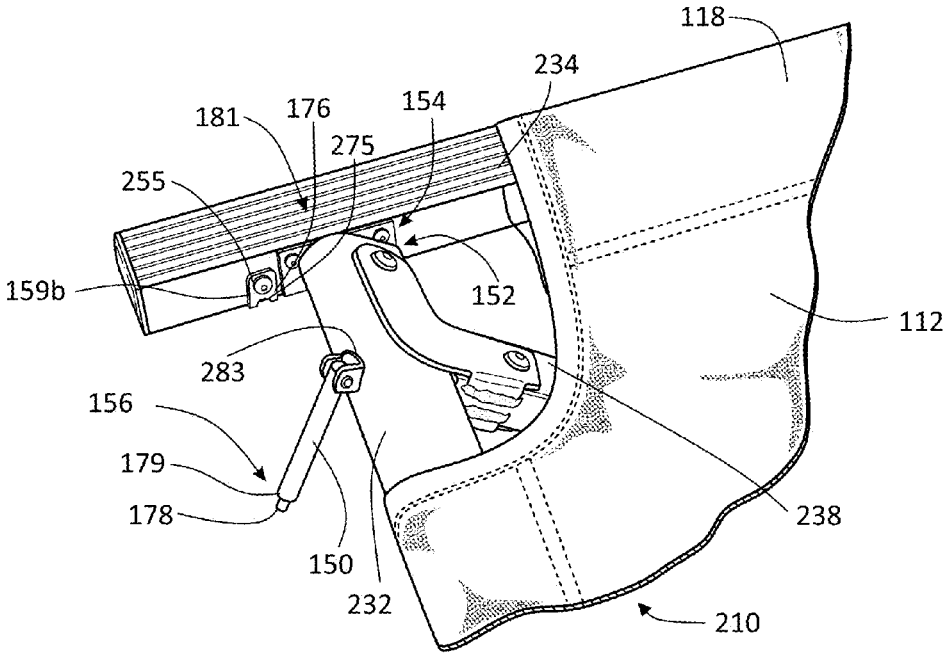

FIGS. 8-10 comprise a partial perspective view of an alternative embodiment of the cot 210. In particular, FIGS. 8-10 illustrate a method of using the assist arm 150 to assemble the cot 210.

The partial view of the cot 210 shown in FIGS. 8-10 does not illustrate all the components of this embodiment of the cot 210. Thus, although not illustrated in FIGS. 8-10, the cot 210 may include some or all of the additional features and components of the cot 110 shown, for example, in FIGS. 1-7. Accordingly, although not illustrated in FIGS. 8-10, the cot 210 of FIGS. 8-10 includes a first and a third connection mechanism 151, 153 and a first side rail 130, and may include other components such as a second end rail 136. However, it should be understood that alternative embodiments of the cot 210 may be configured with or without these additional features and components and that these additional features and components may be embodied in ways different from the manner illustrated in the accompanying figures.

Accordingly, as indicated above, the cot 210 illustrated in FIGS. 8-10 is similar to the cot 110 illustrated in FIGS. 1-7. However, the assist arm 150 illustrated in FIGS. 8-10 is pivotally and/or rotationally connected to the second side rail 232 rather than the first leg 238 of the cot 210. In addition, in the cot 210 illustrated in FIGS. 8-10, the fifth connection mechanism 255 is located at an outside third fixed point **159*b* rather than at an inside third fixed point 159*a* (with the inside third fixed point 159*a* being shown in FIG. 2**).

As illustrated in FIG. 8, the first end rail 234 may be inserted and positioned within the first end channel 118. Further, the first connection mechanism 151 of the first side rail 130 may be engaged with (and optionally pivotally engaged with) the third connection mechanism 153 of the first end rail 234 (an example of engagement between the first and the third connection mechanisms 151, 153 is illustrated in FIG. 3). Without the benefit of the assist arm 150, it may be difficult for a user 131 to secure the second connection mechanism 152 of the second side rail 232 to the fourth connection mechanism 154 of the first end rail 234.

Accordingly, as shown in FIG. 8, a user 131 may hold the arm 150, while also holding the first end rail 234. As illustrated, the fifth connection mechanism 255 of the first end rail 234, in one embodiment, may comprise a reinforcing plate 176 and an aperture 275. With respect to the embodiment shown in FIGS. 8-10, the aperture 275 may extend through the reinforcing plate 176 and into the first end rail 234. In alternative embodiments, the aperture 275 extends only through the reinforcing plate 176 or may comprise a recess or depression within the reinforcing plate 176 and/or the first end rail 234.

In addition, the sixth connection mechanism 156 may comprise a central extension 178 with a recessed shoulder 179. The aperture 275 may be sized to receive the central extension 178. As indicated previously, the fifth and sixth connection mechanisms 255, 156 may be embodied in different ways from those illustrated in FIGS. 8-10. For example, the arm 150 may be positioned on the second side rail 232 at different locations other than the attachment location 283 shown in FIGS. 8-10.

As shown in FIGS. 9-10, the first end rail 234 may be pivoted such that the fifth connection mechanism 255 engages the sixth connection mechanism 156 of the arm 150, while the first connection mechanism 151 engages the third connection mechanism 153 (an example of the engagement between the first and third connection mechanisms 151, 153 is illustrated in FIG. 3). In this state (again referring to FIGS. 9-10), the pivotal radius 280 of the fourth connection mechanism 154 may intersect with the engaging position 181, in which the fourth connection mechanism 154 of the first end rail 234 engages the second connection mechanism 152 of the second side rail 232, which is illustrated specifically in FIG. 10. The arm 150, the engagement between the fifth connection mechanism 255 and the sixth connection mechanism 156, and the engagement between the first connection mechanism 151 and the third connection mechanism 153 (an example of the engagement between the first and third connection mechanisms 151, 153 is illustrated in FIG. 3), enable a user 131 to more easily apply the necessary force to guide the fourth connection mechanism 154 of the first end rail 234 and the second connection mechanism 152 of the second side rail 232 into the engaging position 181.

As illustrated in FIG. 10, once the second connection mechanism 152 has engaged the fourth connection mechanism 154, the fifth connection mechanism 255 and the sixth connection mechanism 156 may disengage.

Figure 11:
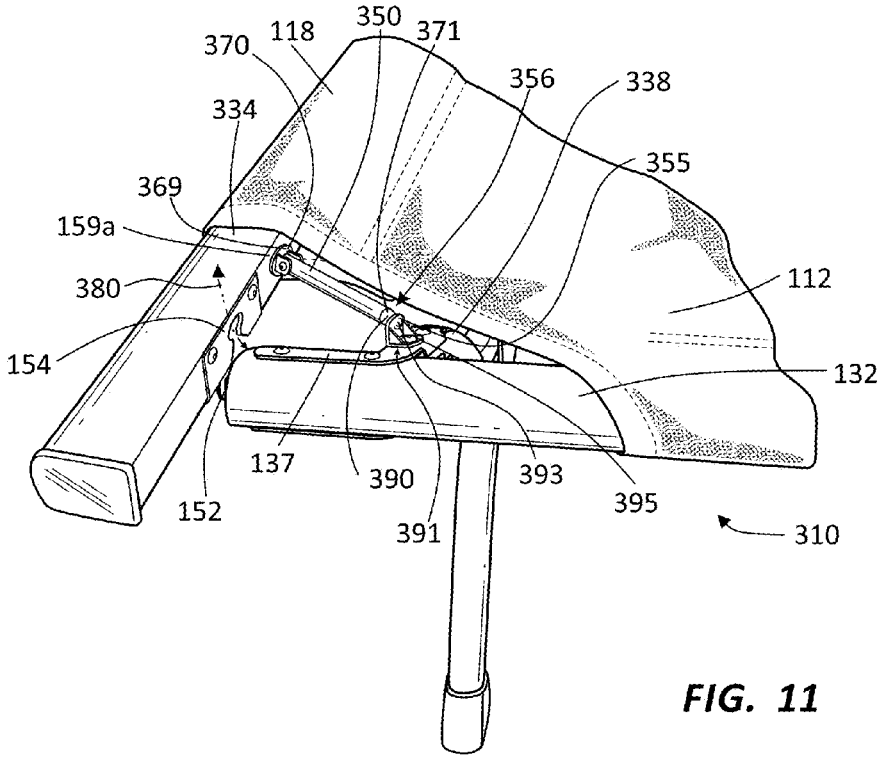
FIGS. 11-13 comprise partial perspective views illustrating a method of assembly of yet another alternative embodiment of a cot.
Figure 12:
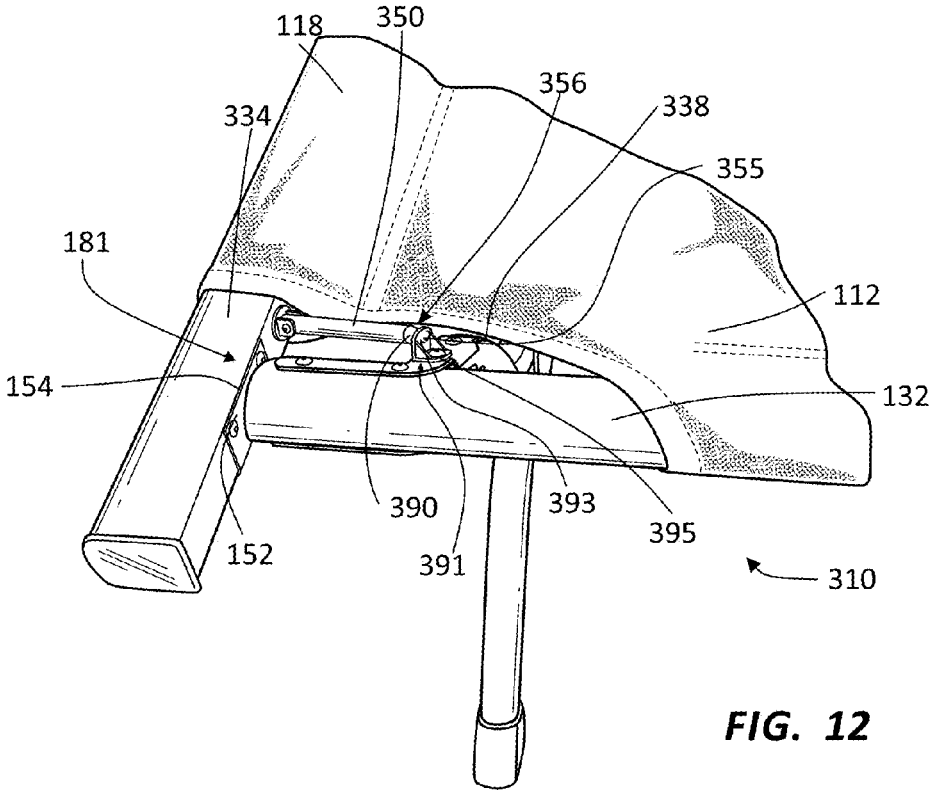
Figure 13:
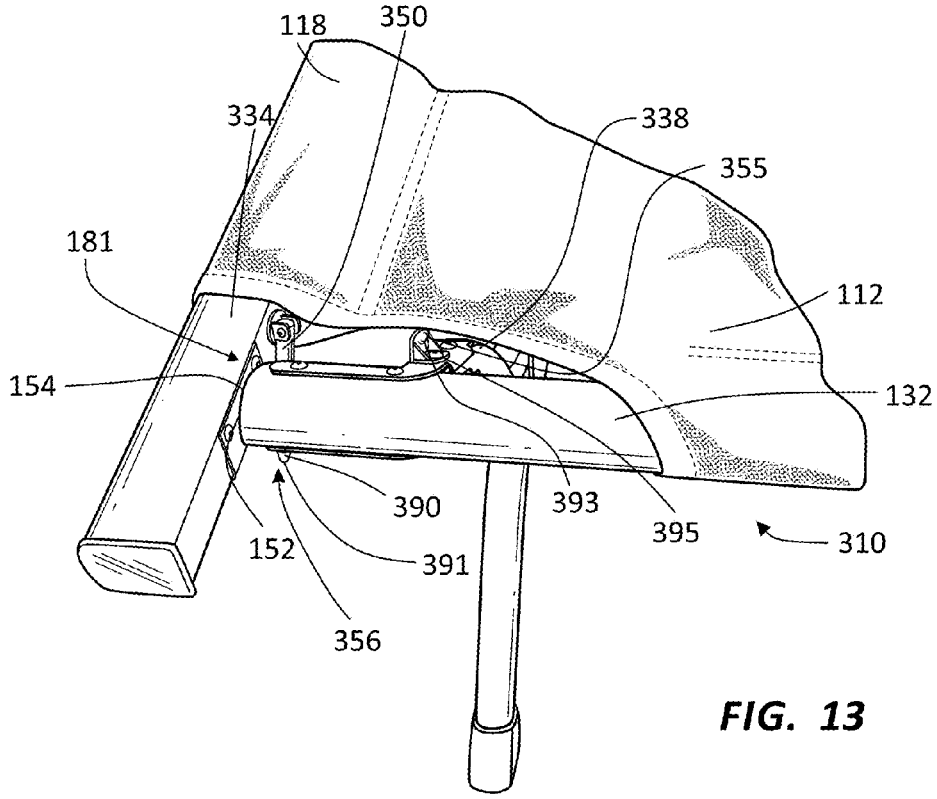

FIGS. 11-13 comprise a partial perspective view of an alternative embodiment of the cot 310. In particular, FIGS. 11-13 illustrate a method of using the assist arm 350 to assemble the cot 310.

The partial view of the cot 310 shown in FIGS. 11-13 does not illustrate all the components of this embodiment of the cot 310. Thus, although not illustrated in FIGS. 11-13, the cot 310 may include some or all of the additional the features and components of the cot 110 shown, for example, in FIGS. 1-7. Accordingly, although not illustrated in FIGS. 11-13, the cot 310 of FIGS. 11-13 includes a first and a third connection mechanism 151, 153 and a first side rail 130, and may include other components such as a second end rail 136. However, it should be understood that alternative embodiments of the cot 310 may be configured with or without these additional features and components and that these additional features and components may be embodied in ways different from the manner illustrated in the accompanying figures.

Accordingly, as indicated above, the cot 310 illustrated in FIGS. 11-13 is similar to the cot 110 illustrated in FIGS. 1-7. However, the assist arm 350 illustrated in FIGS. 11-13 is pivotally and/or rotationally connected to the first end rail 334 at an inside third fixed point 159*a* rather than being connected to the first leg 338 of the cot 310. In addition, in the embodiment illustrated in FIGS. 11-13, the fifth connection mechanism 355 is located on the leg 338, which leg 338 comprises a support member 395 secured to or integral with the leg 338. In alternative embodiments, the fifth connection mechanism 355 may comprise an aperture, recess, or depression positioned on the leg 338 at alternative locations other than the support member 395. Accordingly, the support member 395 may be omitted from certain embodiments of the cot 310.

The support member 395 shown in FIGS. 11-13 may include a recess 393 shaped to receive an extension point 391 of the arm 350. As illustrated in FIGS. 11-13, the arm 350 may comprise a narrowing region 390 and the extension point 391. Thus, as illustrated in FIGS. 11-13, the sixth connection mechanism 356 of the arm 350 may comprise the narrowing region 390 and the extension point 391.

As illustrated in FIG. 11, the first end rail 334 may be inserted and positioned within the first end channel 118. Further, the first connection mechanism 151 of the first side rail 130 may be engaged with (and optionally pivotally engaged with) the third connection mechanism 153 of the first end rail 334 (an example of the engagement between the first and the third connection mechanisms 151, 153 is illustrated in FIG. 3).

As shown in FIGS. 11-13, the first end rail 334 may be pivoted such that the fifth connection mechanism 355 engages the sixth connection mechanism 356 of the arm 350, while the first connection mechanism 151 engages the third connection mechanism 153. In this state, the pivotal radius 380 of the fourth connection mechanism 154 may intersect with the engaging position 181, in which the fourth connection mechanism 154 of the first end rail 334 engages the second connection mechanism 152 of the second side rail 132, which is illustrated specifically in FIG. 12. The arm 350, the engagement between the fifth connection mechanism 355 and the sixth connection mechanism 356, and the engagement between the first connection mechanism 151 and the third connection mechanism 153, enable a user to more easily apply the necessary force to guide the fourth connection mechanism 154 of the first end rail 334 and the second connection mechanism 152 of the second side rail 132 into the engaging position 181.

As illustrated in FIG. 13, once the second connection mechanism 152 has engaged the fourth connection mechanism 154, the fifth connection mechanism 355 and the sixth connection mechanism 356 may disengage.

Figure 14:
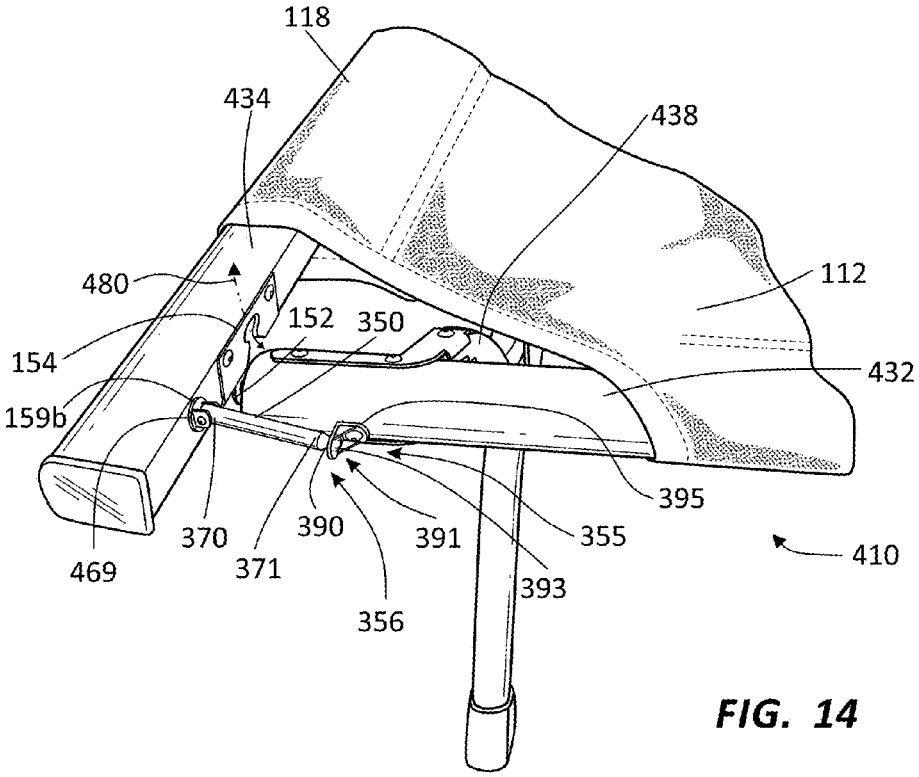
FIGS. 14-16 comprise partial perspective views illustrating a method of assembly of yet another alternative embodiment of a cot.
Figure 15:
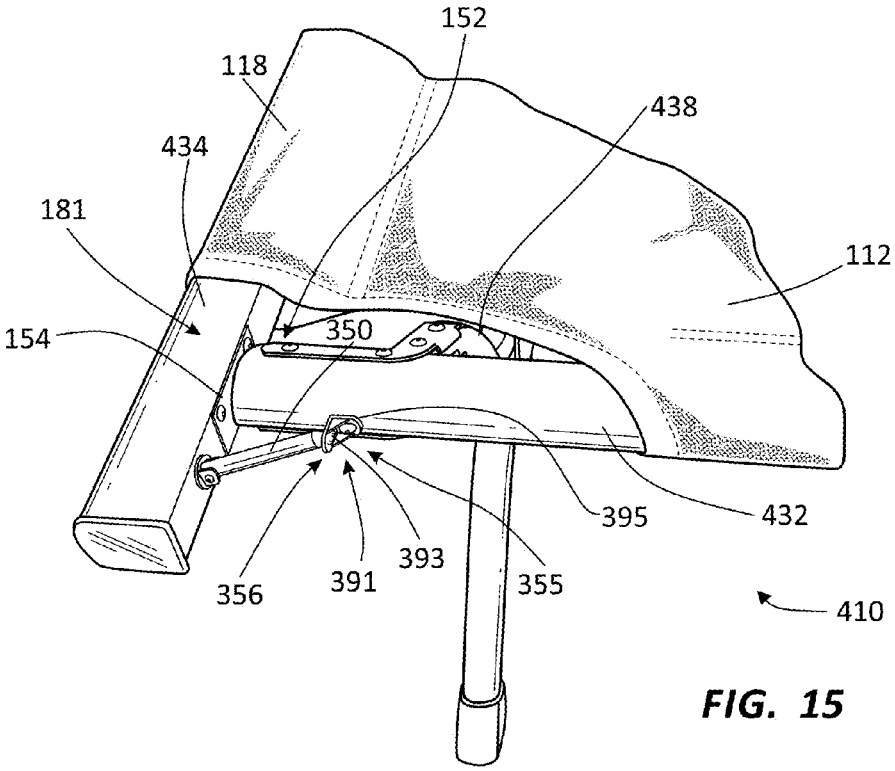
Figure 16:
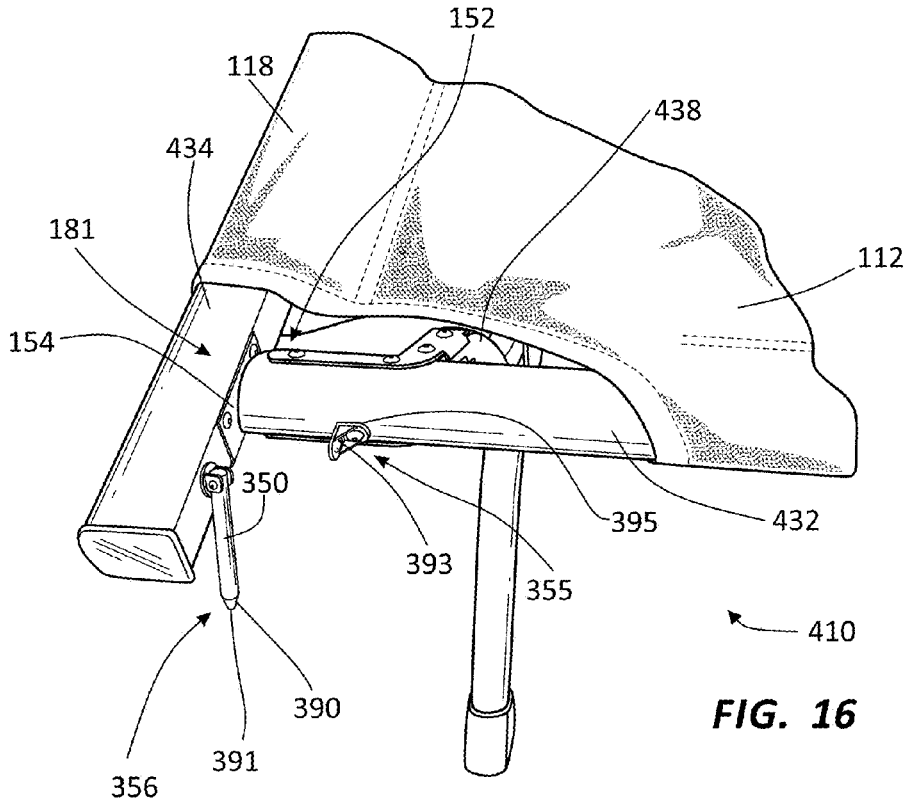

FIGS. 14-16 comprise a partial perspective view of an alternative embodiment of the cot 410. In particular FIGS. 14-16 illustrate a method of using the assist arm 350 to assemble the cot 410.

The partial view of the cot 410 shown in FIGS. 14-16 does not illustrate all the components of this embodiment of the cot 410. Thus, although not illustrated in FIGS. 14-16, the cot 410 may include some or all of the additional features and components of the cot 110 shown, for example, in FIGS. 1-7. Accordingly, although not illustrated in FIGS. 14-16, the cot 410 of FIGS. 14-16 includes a first and a third connection mechanism 151, 153 and a first side rail 130, and may include other components such as a second end rail 136. However, it should be understood that alternative embodiments of the cot 410 may be configured with or without these additional features and components and that these additional features and components may be embodied in ways different from the manner illustrated in the accompanying figures.

Accordingly, as indicated above, the cot 410 illustrated in FIGS. 14-16 is similar to the cot 110 illustrated in FIGS. 1-7. However, the assist arm 350 illustrated in FIGS. 14-16 is pivotally and/or optionally rotationally connected to the first end rail 434 at an outside third fixed point 159*b* rather than being connected to the first leg 438 of the cot 410. In addition, the second side rail 432 may have a fifth connection mechanism 355, which second side rail 432 may include a support member 395 secured to or integral with the second side rail 432.

The arm 350 may include a narrowing region 390 and an extension point 391. The support member 395 may comprise a recess 393 sized to receive the extension point 391. In various alternative embodiments, the support member 395 may include an aperture rather than a recess 393. Also, in various alternative embodiments, the arm 350 may include a recessed shoulder 179 and an extension 178 (which are illustrated, for example, in FIG. 4).

As illustrated in FIG. 14, the first end rail 434 may been inserted and positioned within the first end channel 118. Further, the first connection mechanism 151 of the first side rail 130 may be engaged (and, in one embodiment, may pivotally engage) with the third connection mechanism 153 of the first end rail 434 (an example of the engagement between the first and the third connection mechanisms 151, 153 is illustrated in FIG. 3). Without the benefit of the assist arm 350, it can be difficult for a user to secure the second connection mechanism 152 of the second side rail 432 to the fourth connection mechanism 154 of the first end rail 434.

As shown in FIGS. 14-15, the first end rail 434 may be pivoted such that the fifth connection mechanism 355 engages the sixth connection mechanism 356 of the arm 350, while the first connection mechanism 151 engages the third connection mechanism 153. In this state, the pivotal radius 480 of the fourth connection mechanism 154 may intersect with the engaging position 181, in which the fourth connection mechanism 154 of the first end rail 434 engages the second connection mechanism 152 of the second side rail 432, which is illustrated specifically in FIG. 15. The arm 350, the engagement between the fifth connection mechanism 355 and the sixth connection mechanism 356, and the engagement between the first connection mechanism 151 and the third connection mechanism 153, enable a user to more easily apply the necessary force to guide the fourth connection mechanism 154 of the first end rail 434 and the second connection mechanism 152 of the second side rail 432 into the engaging position 181.

As illustrated in FIG. 16, once the second connection mechanism 152 has engaged the fourth connection mechanism 154, the fifth connection mechanism 355 and the sixth connection mechanism 356 may disengage.

The disclosed cots 110, 210, 310, 410 may be embodied in various ways. For example, one skilled in the art will appreciate that features disclosed in connection with one of the cots 110, 210, 310, 410 may be used with other embodiments of the cots 110, 210, 310, 410. For example, as indicated previously, the connection mechanisms may comprise a male-type or female-type connection mechanisms that may mate with a corresponding connection mechanism, such that the fourth connection mechanism 154 could comprise a male-type connection mechanism and the mating second connection mechanism 152 may comprise a female-type connection mechanism. As an additional example, the arm 150 shown in connection with FIG. 4 may include a narrowing region 390 and extension point 391 in place of a central extension 178 and recessed shoulder 179. As noted, the fifth connection mechanism may comprise an aperture, recess, or depression.

The arm may be pivotally connected to an end rail, side rail, leg, and/or a pivoting mechanism. Also, more than one arm may be included on each cot 110, 210, 310, 410. For example, an arm 150 may be secured to two or four legs of the cot 110, 210, 310, 410. Furthermore, the arms on the single cot 110, 210, 310, 410 may be attached to different portions of the cot 110, 210, 310, 410, such as having a first arm pivotally connected to a leg while a second arm is pivotally connected to an end bar. Also, as indicated above, the fifth and sixth connection mechanisms may temporarily engage during certain stages of the assembly process or only during one or more stages of the assembly process. The mechanisms and methods disclosed herein may be used in connection with any type of folding bed frame.

As noted previously, it may be desirable that a support fabric of a cot be stretched or pulled tight to achieve a desired level of tautness following assembly of the cot. The methods and mechanisms disclosed above facilitate assembly of a cot with a desired level of tautness. Furthermore, in various embodiments, the methods and mechanisms disclosed herein enable assembly of a cot with a higher level of tautness than could previously be achieved without rendering assembly too difficult or impossible. For example, as indicated above, the arm enables a user to apply greater force to guide a fourth connection mechanism of an end rail into an engaging position with a second connection mechanism of a side rail, thus enabling a high level of tautness of the support fabric without rendering assembly unduly difficult or impossible.

It is understood that any specific order or hierarchy of steps in any disclosed process is an example of a sample approach. Based upon design preferences, it is understood that the specific order or hierarchy of steps in the processes may be rearranged while remaining within the scope of the present disclosure. The accompanying method claims present elements of the various steps in a sample order, and are not meant to be limited to the specific order or hierarchy presented.

The previous description of the disclosed aspects is provided to enable any person skilled in the art to make or use the present disclosure. Various modifications to these aspects will be readily apparent to those skilled in the art, and the generic principles defined herein may be applied to other aspects without departing from the scope of the disclosure. Thus, the present disclosure is not intended to be limited to the aspects shown herein but is to be accorded the widest scope consistent with the principles and novel features disclosed.

What is claimed is:

1. A cot having an assist arm, comprising:

a first side rail having a first connection mechanism;

a second side rail having a second connection mechanism;

a leg secured to the second side rail;

a pivoting mechanism that pivotally secures the leg to the second side rail;

a support fabric having a first peripheral side channel shaped to receive the first side rail and a second peripheral side channel shaped to receive the second side rail, the first peripheral side channel and the second peripheral side channel being disposed on opposing sides of the support fabric;

an end rail having a longitudinal axis, a third connection mechanism, a fourth connection mechanism, and a fifth connection mechanism, the third connection mechanism shaped to engage the first connection mechanism and located at a first fixed point along the longitudinal axis, the fourth connection mechanism shaped to engage with the second connection mechanism and located at a second fixed point along the longitudinal axis, the fifth connection mechanism located at a third fixed point between the first fixed point and the second fixed point relative to the longitudinal axis of the end rail; and an arm having a proximal end and a distal end, the proximal end pivotally secured to at least the leg or the pivoting mechanism, the distal end comprising a sixth connection mechanism shaped to interface with the fifth connection mechanism, wherein the arm is dimensioned such that when the sixth connection mechanism is engaged with the fifth connection mechanism and the first connection mechanism is engaged with the third connection mechanism, a pivotal radius of the fourth connection mechanism of the end rail intersects with an engaging position in which the fourth connection mechanism engages the second connection mechanism.

2. The cot of claim 1, wherein the proximal end of the arm is pivotally and rotatably secured to the leg.

3. The cot of claim 1, wherein the sixth connection mechanism comprises a central extension and a recessed shoulder.

4. The cot of claim 3, wherein the fifth connection mechanism comprises an aperture shaped to receive the central extension.

5. The cot of claim 4, wherein the aperture is surrounded by a reinforcing plate.

6. The cot of claim 1, wherein the first connection mechanism comprises a head, a neck and a shoulder.

7. The cot of claim 6, wherein the third connection mechanism comprises an opening having a wide region shaped to receive the head and a narrow region shaped to receive the neck.

8. A cot having an assist arm, comprising:

a first side rail having a first connection mechanism;

a second side rail having a second connection mechanism;

a leg secured to the second side rail;

a support fabric having a first peripheral side channel shaped to receive the first side rail and a second peripheral side channel shaped to receive the second side rail, the first peripheral side channel and the second peripheral side channel being disposed on opposing sides of the support fabric;

an end rail having a longitudinal axis, a third connection mechanism, a fourth connection mechanism, and a fifth connection mechanism, the third connection mechanism shaped to engage the first connection mechanism and located at a first fixed point along the longitudinal axis, the fourth connection mechanism shaped to engage with the second connection mechanism and located at a second fixed point along the longitudinal axis, the fifth connection mechanism located at a third fixed point located outside the first fixed point and the second fixed point along the longitudinal axis of the end rail; and an arm having a proximal end, and a distal end, the proximal end being pivotally secured to the second side rail, the distal end comprising a sixth connection mechanism shaped to interface with the fifth connection mechanism, wherein the arm is dimensioned such that when the sixth connection mechanism is engaged with the fifth connection mechanism and the first connection mechanism is engaged with the third connection mechanism, a pivotal radius of the fourth connection mechanism of the end rail intersects with an engaging position in which the fourth connection mechanism engages the second connection mechanism.

9. The cot of claim 8, wherein the proximal end of the arm is pivotally and rotatably secured to the leg.

10. The cot of claim 8, wherein the sixth connection mechanism comprises a central extension and a recessed shoulder.

11. The cot of claim 10, wherein the fifth connection mechanism comprises an aperture shaped to receive the central extension.

12. The cot of claim 11, wherein the aperture is surrounded by a reinforcing plate.

13. The cot of claim 8, wherein the first connection mechanism comprises a head, a neck and a shoulder.

14. A cot having an assist arm, comprising:

a first side rail having a first connection mechanism;

a second side rail having a second connection mechanism;

a leg secured to the second side rail;

an end rail having a longitudinal axis, a third connection mechanism, a fourth connection mechanism, the third connection mechanism shaped to engage the first connection mechanism and located at a first fixed point along the longitudinal axis, the fourth connection mechanism shaped to engage with the second connection mechanism and located at a second fixed point along the longitudinal axis;

a fifth connection mechanism disposed on either the leg or the second side rail;

a support fabric having a first peripheral side channel shaped to receive the first side rail and a second peripheral side channel shaped to receive the second side rail, a first end channel shaped to receive the end rail, the first peripheral side channel and the second peripheral side channel being disposed on opposing sides of the support fabric, the first end channel being generally perpendicular to the first peripheral side channel;

an arm having a proximal end, and a distal end, the proximal end being pivotally secured to the end rail, the distal end comprising a sixth connection mechanism shaped to interface with the fifth connection mechanism, wherein the arm is dimensioned such that when the sixth connection mechanism is engaged with the fifth connection mechanism and the first connection mechanism is engaged with the third connection mechanism and the end rail is disposed within the first end channel, a pivotal radius of the fourth connection mechanism of the end rail intersects with an engaging position in which the fourth connection mechanism engages the second connection mechanism.

15. The cot of claim 14, wherein the fifth connection mechanism is disposed on the side rail.

16. The cot of claim 14, wherein the fifth connection mechanism is disposed on the leg.

17. The cot of claim 14, further comprising a third fixed point located on the end rail, the third fixed point being located between the first fixed point and the second fixed point relative to the longitudinal axis of the end rail, the arm being pivotally secured to the third fixed point.

18. The cot of claim 14, further comprising a third fixed point located on the end rail, the third fixed point being located outside the first fixed point and the second fixed point relative to the longitudinal axis of the end rail, the arm being pivotally secured to the third fixed point.

19. The cot of claim 14, wherein the proximal end of the arm is pivotally and rotatably secured to the end rail.

20. The cot of claim 14, wherein the sixth connection mechanism comprises a central extension and a recessed shoulder.

* * * * *